United States Patent [19]

Litvak et al.

[11] Patent Number: 4,922,638

[45] Date of Patent: May 8, 1990

[54] DECORATIVE MODULAR PICTURE FRAME

[76] Inventors: Joel Litvak, 150-11 Reeves Ave., Flushing, N.Y. 11367; Neil Kriegsfeld, 41-42 73rd St., Woodside, N.Y. 11377

[21] Appl. No.: 409,939

[22] Filed: Sep. 20, 1989

Related U.S. Application Data

[63] Continuation of Ser. No. 167,383, Mar. 11, 1988, abandoned.

[51] Int. Cl.[5] ..... A47G 1/10

[52] U.S. Cl. ..... 40/155; 40/152; 40/154

[58] Field of Search ..... 40/152, 154, 155; 52/656

[56] References Cited

U.S. PATENT DOCUMENTS

| | | | |
|---|---|---|---|
| 132,114 | 10/1872 | Stevens | 403/401 |
| 956,711 | 5/1910 | Kellogg | 403/401 |
| 1,165,155 | 12/1915 | Cordes | 403/401 |
| 3,266,361 | 8/1966 | Gravenhorst et al. | 40/152 |
| 3,425,721 | 2/1969 | Agee | 403/401 |
| 3,494,647 | 2/1970 | Farley | 52/656 |
| 4,428,135 | 1/1984 | Sobel | 40/152 |
| 4,438,578 | 3/1984 | Logan | 40/152 |
| 4,477,990 | 10/1984 | Buchanan | 40/152 |

FOREIGN PATENT DOCUMENTS

| | | | |
|---|---|---|---|
| 816971 | 7/1969 | Canada | 403/402 |
| 1168445 | 6/1984 | Canada | 40/152 |
| 2037682 | 2/1971 | Fed. Rep. of Germany | 40/155 |
| 3033446 | 4/1982 | Fed. Rep. of Germany | 40/152 |
| 2559046 | 8/1985 | France | 403/402 |

*Primary Examiner*—Michael Safavi

*Attorney, Agent, or Firm*—Bernard J. Murphy

[57] ABSTRACT

A decorative modular picture frame is described, in which the frame sections employed are milled at their opposing ends to accept corner bracket extensions in an interlocking and interchangeable relationship, so as to provide a construction characterized by the corner brackets becoming an integral part of the frame, affording both structural integrity and a decorative appearance according to individual user preference.

9 Claims, 5 Drawing Sheets

DECORATIVE MODULAR PICTURE FRAME

This is a continuation of application Ser. No. 07/167,383, filed on 03/11/88.

FIELD OF THE INVENTION

This invention relates to picture frame constructions, in general, and to the fabrication of a picture frame construction offering decorative features for all frameable subject matter, in particular.

BACKGROUND OF THE INVENTION

As is well known and understood by those skilled in the art, many different techniques are presently available for the joining of adjacent picture frame members in a completed construction. As is also well known, a major portion of the industry is concerned with "decorative framing", where it is not unusual to find such constructions costing as much as several hundreds of dollars. With "picture decorators " spending significant amounts of time in the crafting of the apppropriate corners which match the aesthetics of all framable subjects through such techniques as "cutting", "carving", "arranging" and other "composings", in general, it is not uncommon for a customer to wait some 4–8 weeks for a frame construction to be completed. Techniques have been proposed for adhering the decorative corners so crafted onto the frame sections adjacently joined, and other techniques have been proposed to utilize a corner construction which, itself, serves in securing the adjacent frame sections together. However, whereas such latter proposals have met with a degree of success, the level of consumer acceptance has been quite limited, and because the resulting construction exhibited an overall appearance where it is fairly obvious that the decorative corner was merely an "add-on" to an existent frame construction, and cheapened the "look" desired. This tendency became all the more pronounced as the quality of the frameable matter increased, and the "patch-like" appearance became more pronounced.

OBJECTS OF THE INVENTION

It is an object of the present invention, therefore, to provide an improved picture frame assembly suitable for decorative purposes.

It is also an object of the invention to provide such a picture frame assembly which can be fabricated at a far lower cost.

It is a further object of the invention to provide such an improved picture frame assembly comparable in appearance to a hand-crafted frame which can be easily assembled.

It is yet another object of the invention to provide such a decorative picture frame assembly which can readily be assembled in accordance with individual user preference in meeting the decorative desires believed to be consistent with the display of the frameable item.

It is a still further object of the invention to provide a decorative picture frame assembly which readily lends itself to a mass-type production yet without detracting from the decorative nature of the presentation and appearance produced.

SUMMARY OF THE INVENTION

As will become clear hereinafter, the present invention describes a modular picture frame assembly in which the picture frame sections employed are milled, or otherwise formed at their opposing ends so as to accept specifically defined extensions of selected, decorative corner brackets in an interlocking and interchangeable relationship. As will be seen, the corner bracket extensions align with end portions of the frame sections so as to mate therewith, and with the relative dimensionings and configurations of the bracket and frame sections being such as to cause the mating components to fit "flush" with, or, fair into, one another. This gives the picture frame assembly an overall appearance in which the corner bracket becomes an integral part of the frame—rather than an "add-on". By further manufacturing of the corner bracket from a base, plastic material, in addition, manufacture can proceed through readily available injection-molding techniques; thereafter, many types of finishes can be applied, such as vacuum-type plating, painting, antiquing, and a variety of textures and engraving can be added on, as well. By the injection-molding of any desired corner bracket shape—e.g., round corner, convex corner, concave corner, modern corner, traditional corner, oriental corner, etc.—a very wide selection of corner brackets becomes available, to match with the material of the frame section in producing the overall appearance desired by the user.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
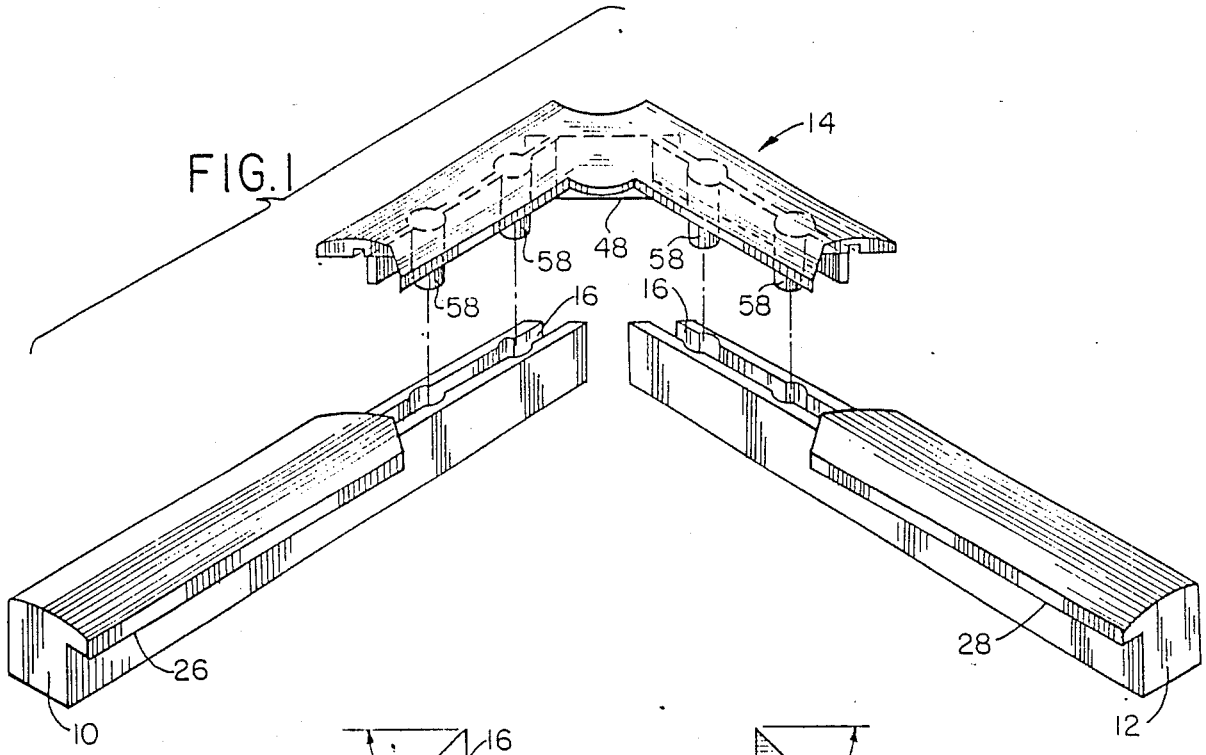
FIG. 1 is a perspective view of a corner bracket and frame assembly construction helpful in an understanding of the present invention.
Figure 2A:
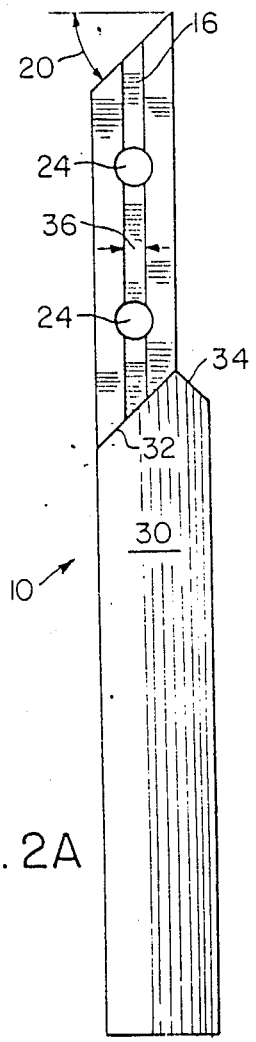
FIGS. 2A and 2B are top views of the frame section components of FIG. 1.
Figure 2B:
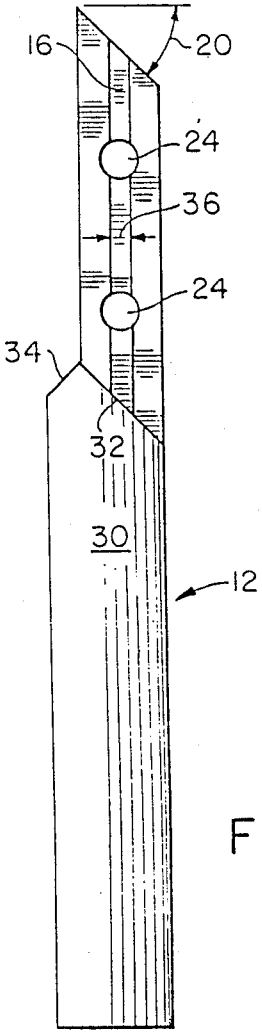
Figure 3B:
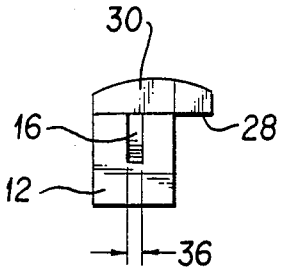
FIGS. 3A and 3B are end views of the frame section members shown in the illustration of FIG. 1.
Figure 3A:
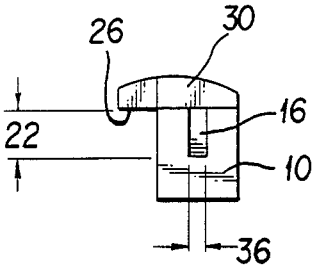
Figure 4A:
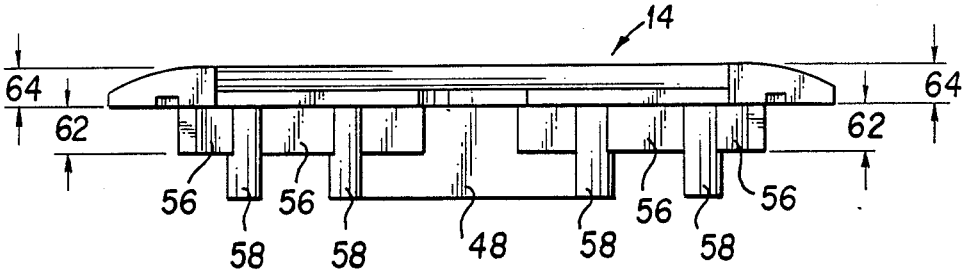
FIGS. 4A and 4B are front and bottom views, respectively, of the corner bracket shown in FIG. 1 as constructed according to the teachings of the invention.
Figure 4B:
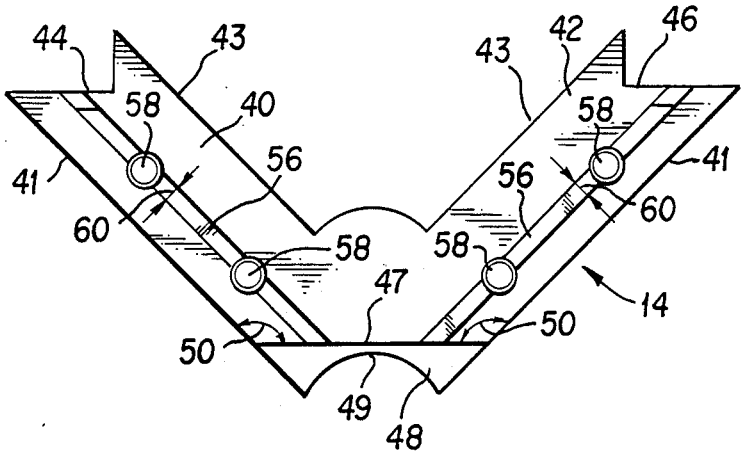
Figure 5:
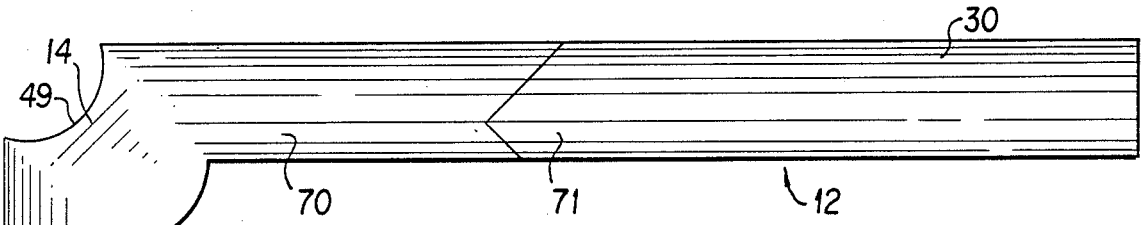
FIG. 5 illustrates one corner of a decorative modular picture frame constructed utilizing the principles of the invention.

Referring to the drawings, the frame section members employed in arranging one corner of the modular frame construction are illustrated by the reference numerals 10, 12 and the corner bracket which joins them in an interlocking and interchangeable relationship is shown at 14. As will be seen, each of the frame section members 10, 12 is provided with a channel 16, extending inwardly of the member 10, 12, and along its length, measured from the adjacent ends 18 terminate at a predetermined angle 20. The depth of the channel 16—fabricated as by milling or any comparable forming technique—is shown at 22, and, in accordance with a preferred embodiment of the invention, is also provided with a pair of apertures 24 each, for a purpose explained in the ensuing text where structural integrity and resistance to warpage is of significance to the overall construction. Although not shown, it will be appreciated that the remote end of the frame section member—fabricated of wood, metal, or any other material to exhibit the rigidity needs of the construction—are similarly milled, or otherwise formed, of predetermined angle and of channel depth (with, or without, apertures) in forming the other three corners of the completed picture frame. As illustrated, the frame section members 10,12 each have a frame front face 25 and a frame rear face 25*a*, and a shelf 26,28 which underlies the front face 25 and lies parallel with the rear face 25*a*. The convex molding appearance exhibited by the external decorative surface of the frame members 10,12 is noted by the index number 30; the aforesaid surface 30 terminates in a V-shaped surface 32, 34.

Figure 6:
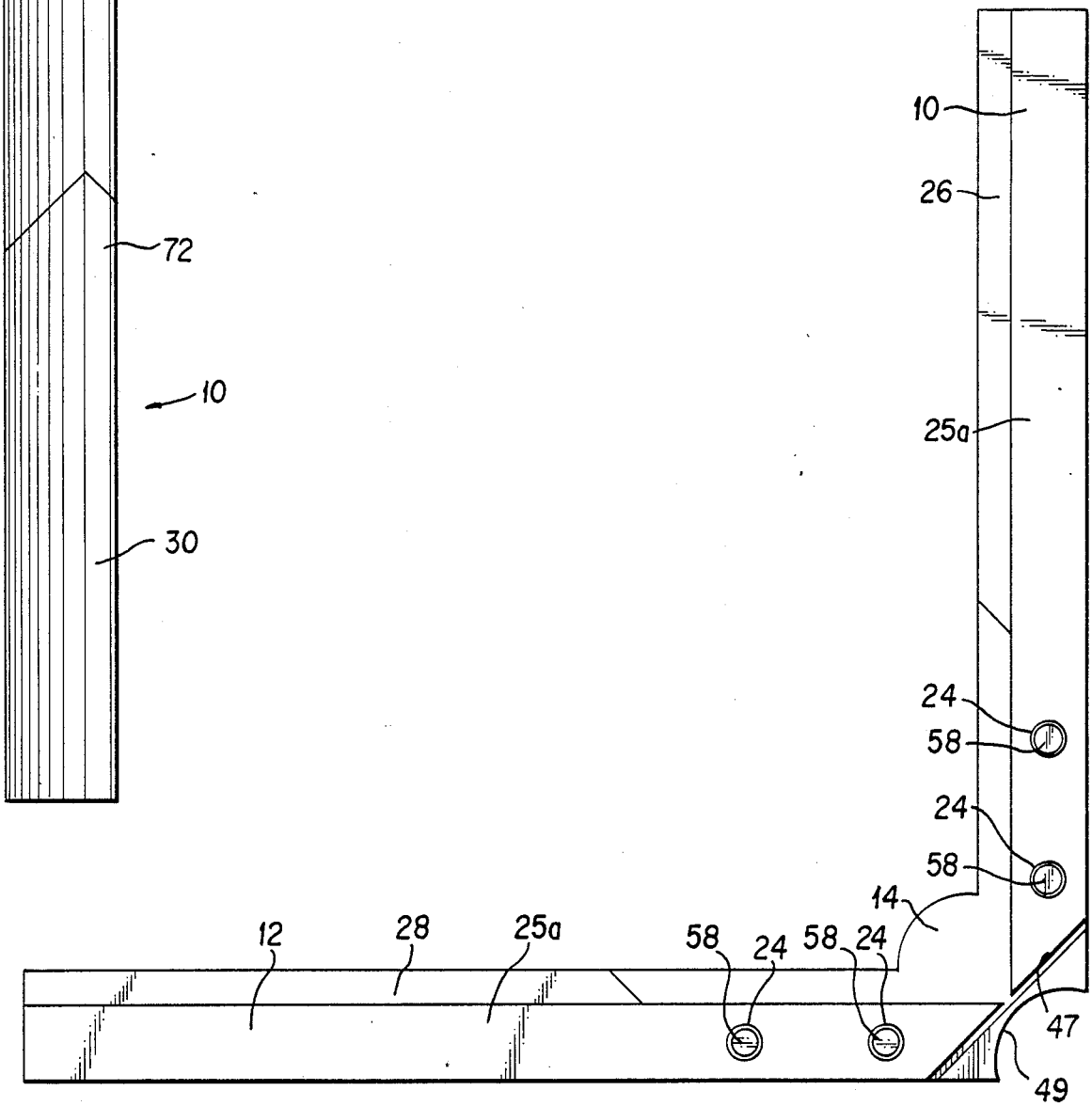
FIG. 6 illustrates a bottom view of the picture frame construction of the invention.

In considering the corner bracket 14, on the other hand, it will first be appreciated that it has two arms 40,42 integrally joined, and forming an angle therebetween, which terminate at their ends 44, 46 in a V-shaped configuration which is the complement of the V-shaped ends 32,34. Each arm 40, 42 has a frame outer edge 41 and a frame inner edge 43. Further, each bracket 14 has a prominent, shouldered abutment surface 47 which is a continuum extending between said outer edges 41. Surface 47, formed on a reference segment 48, forms an angle 50 with the arms 40,42. The beveled ends 18 of the frame section members 10,12 are in abutting relationship with the surface 47; the angles 20 and 50 combine to dispose the members 10,12, thereby, in a ninety degree or right-angular relationship. In furthering the alignment between the corner bracket 14 and the frame section members 10, 12, the corner bracket 14 is provided with a pair of longitudinal extensions 56, corresponding in length with the section member channel 16, and with a pair of prong projections 58 situated along the extension 56 so as to align with the apertures 24 preferably formed in the frame section member channel. As will be appreciated by those skilled in the art, the diameter of the prong projections 58 (where employed) will be only slightly less than the diameter of the apertures 24, whereas the width 60 of the longitudinal extensions 56 will be only slightly less than the width 36 of the channel 16. As will be apparent, such corresponding dimensionings between the angles, lengths, widths and depths between the frame section members 10, 12 (and its included channel) together with the extensions and prong projections of the corner bracket results in a snug-fit between such components when fitted together. By further selecting the height 62 of the corner bracket longitudinal extension 56 to be comparable to the depth 22 of the channel 16, and by selecting the thickness 64 of the corner bracket arms 40, 42 to correspond with the thickness of the frame section shelves 26, 28, a press-fit will exist between the frame section members and the corner bracket, by which the facing surfaces 70, 71 and 72 align flush, and in a continuous line. Where the V-shaped surfaces 32,34 and 44,46 mate, the facing surfaces 71 and 72 fair into the joined surface 70 of the bracket 14. Thereat, at the V-shaped surfaces' juncture, the surface 70 is of the same, decorative configuration as the surface 30. A reference segment outer surface 49 is shown to be concave in the (FIG. 6). Any alternative shape can be opted for the corner bracket at its surface 49—such as round, convex, square, complex, etc.—without detracting from the scope of the teachings of the invention. In the embodiment illustrated, furthermore, it will be appreciated that the prong projections 58 afford added stability to the structural composition, and especially in preventing against any warpage that might tend to develop over a period of time. As with the wide choice of available shapes for the reference segments surface 49, it will be apparent that any number of available surface finishes can be selected as well, to meet any desire consistent with user preference.

Utilizing the invention as thus descrbied would permit an injection molding of the corner bracket when fabricated of a plastic type material, with the cost benefits there attendant. By utilizing standard milling, or other forming, techniques, the frame section members can be similarly mass-produced. With techniques then available, it becomes a fairly simple matter for a consumer to purchase the type of corner brackets he or she desires, and to match them up with the kind of material chosen for the frame section members in completing the picture frame construction. All that would be required is to select the appropriately lengthed section members and the appropriately widthed corner bracket—which could be done either by the customer or by the "picture decorator" in a matter of minutes. The following putting-together of the four corner brackets and four section members takes virtually minutes only, such that the installation of the frameable subject in any appropriate manner within the frame, as along the undersides of the shelves 26, 28 (FIG. 6), can be such as to complete the overall finishing of the final picture product in a short period of time. As will be apparent, the time savings involved, and the reduced amount of hand-work necessary, serves to reduce the total cost to the consumer.

Figure 8:
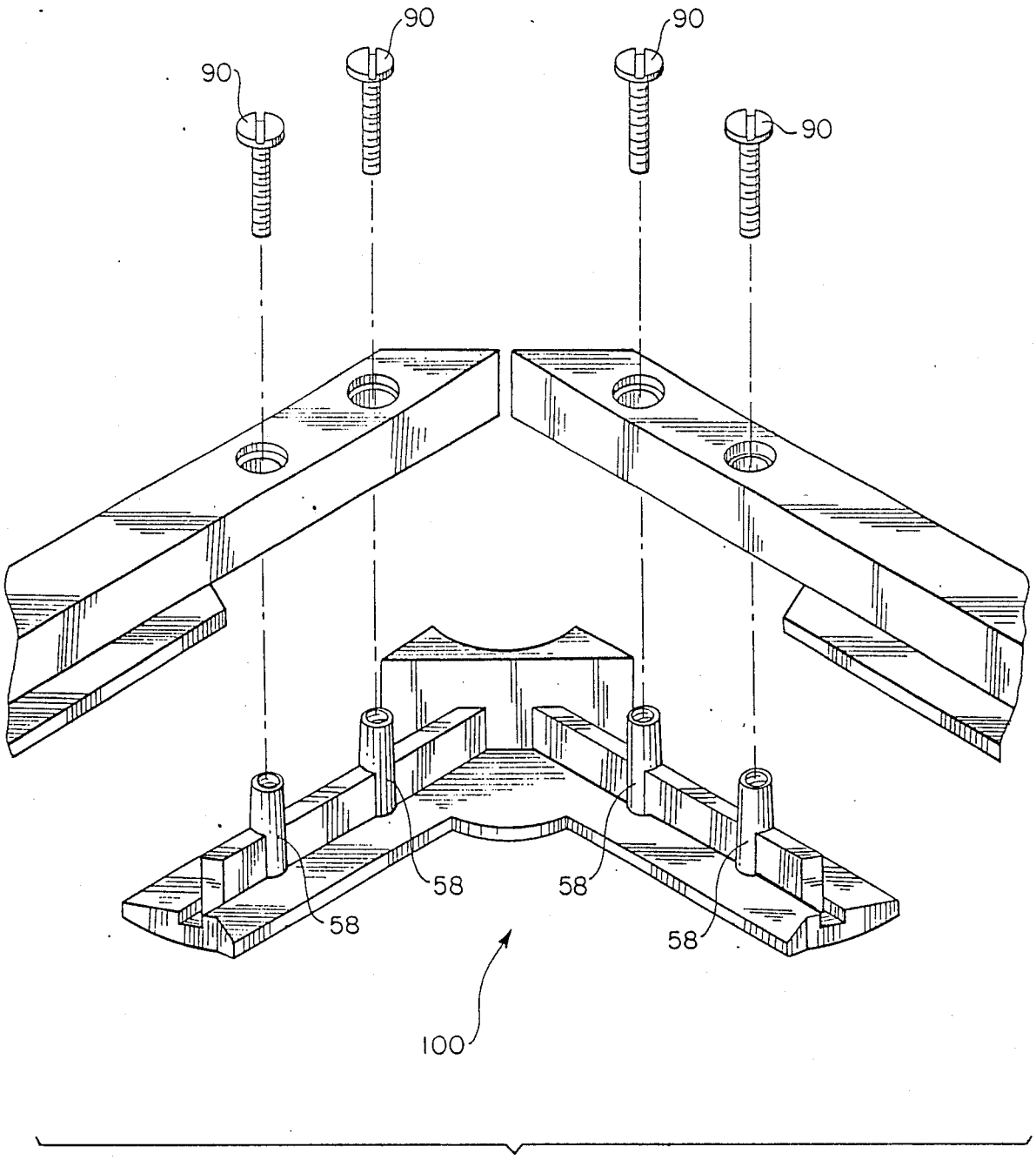
FIGS. 7 and 8 are further perspective views helpful in an understanding of the invention.
Figure 7:
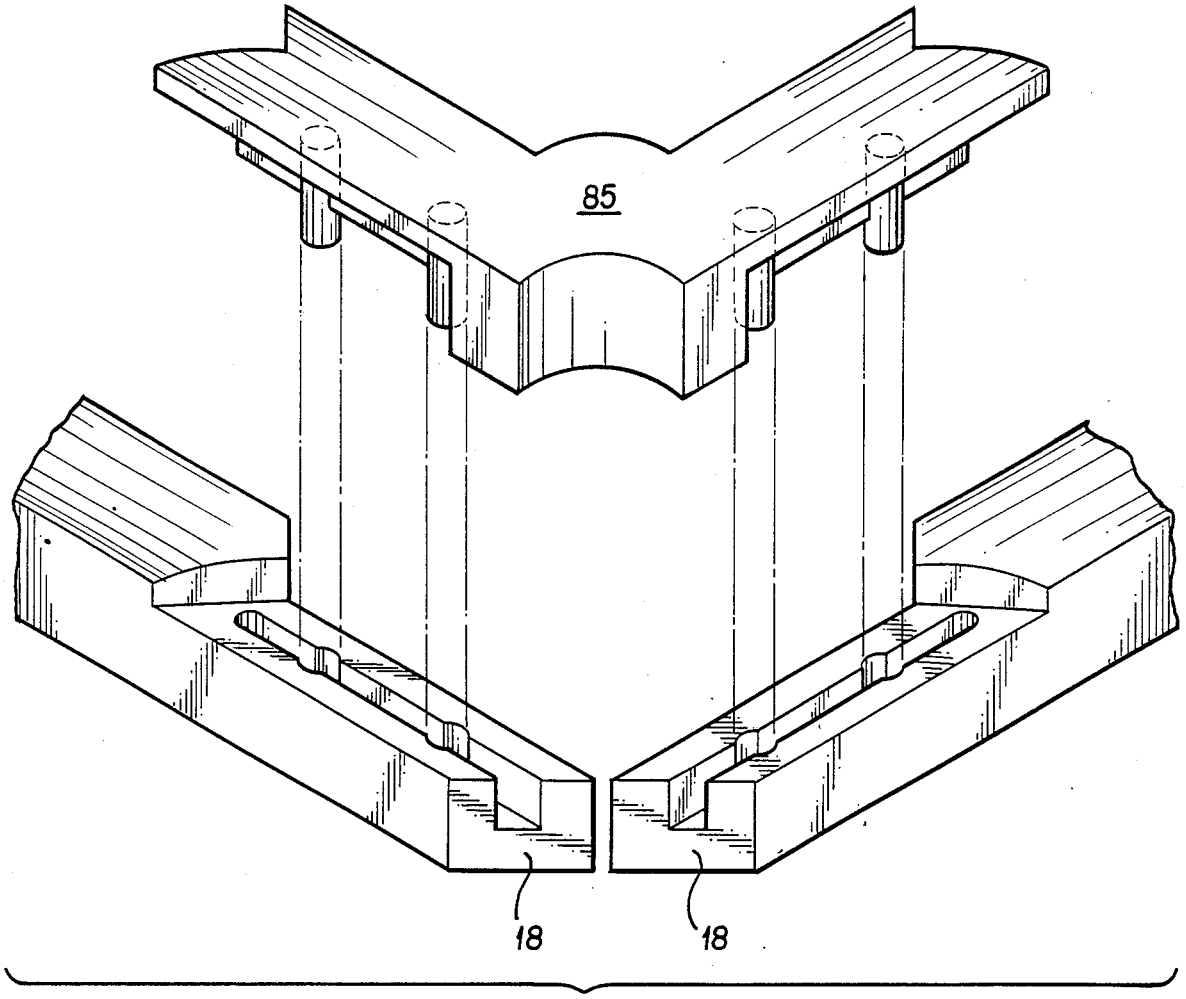

While there have been described what are considered to be preferred embodiments of the present invention, it will be readily appreciated by those skilled in the art that modifications can be made without departing from the scope of the teachings herein of affording a decorative modular frame to be fabricated quickly and inexpensively through a "step-dimension" system with matching angles so as to permit a variety of decorative designs to be had and with the surfaces all being flush and continuous. As will also be apparent, the various orientations of the corner bracket members with respect to the adjacent frame section members would have to be modified, depending upon whether one is forming the left or right-hand corners of the frame, and whether the corners are at the top or bottom of the construction. Although the individual orientation of the bracket and frame section members may be reversed for this use, the principles of the described embodiment will continue the same. Thus, for example, FIG. 7 illustrates the method of installation for a round corner bracket 85, while FIG. 8 shows an installation utilizing a plurality of screw fasteners 90 to secure to the prong projections 58 in holding the corner 100 fixed in place. For at least such reason, therefore, resort should be had to claims appended hereto for a true understanding of the present invention, independent of the ultimate shape selected by the consumer according to his, or her, individual preference and taste.

We claim:

1. A picture frame assembly, comprising:

a plurality of elongate, frame section members; and a plurality of corner brackets for coupling together pairs of said members; wherein each corner bracket has a pair of arms which are integrally joined and form an angle therebetween;

each arm has a frame outer edge and a frame inner edge;

each corner bracket further has a prominent, shouldered abutment surface which is a continuum extending from said outer edge of one of said arms to said outer edge of the other of said arms of said pair;

each of said arms further has a longitudinal extension which commences at said abutment surface of said bracket and extends therefrom, lengthwise of said arm;

each frame section member has a beveled end;

said beveled ends of pairs of said members are in abutting relationship with said abutment surface of one of said corner brackets of said plurality thereof;

each frame section member further has a channel formed therein which extends lengthwise of said member from said beveled end thereof; and said longitudinal extensions of said arms of said corner brackets are nestably set in said channels of said frame section members.

2. A picture frame assembly, according to claim 1, wherein:

each said frame section member has a frame front face, and a frame rear face, and a shelf which underlies said front face and lies parallel with said rear face.

3. A picture frame assembly, according to claim 2, wherein:

each said frame front face terminates in a V-shaped surface;

each arm of said corner brackets also terminates in a V-shaped surface which is the complement of the V-shaped surfaces of said frame front faces; and said V-shaped surfaces of said arms and said frame front faces are nestably mated together.

4. A picture frame assembly, according to claim 3, wherein:

said frame front face of each member, where nestably mated with one of said arms, fairs into an external surface of its respective, mated arm.

5. A picture frame assembly, according to claim 2, wherein:

said frame front faces of said section members have decorative surface configurations.

6. A picture frame assembly, according to claim 4, wherein:

said frame front face of each member has a decorative surface configuration; and said external surface of said respective, mated arm, whereat said front face fairs thereinto, has the same, aforesaid decorative surface configuration.

7. A picture frame assembly, according to claim 6, further including:

apertures formed in said members; and projections, extending from said brackets, in penetration of said apertures.

8. A picture frame assembly, according to claim 6, further including:

a plurality of throughgoing apertures, formed in each of said channels; and projections, extending from said brackets, in penetration of said apertures.

9. A picture frame assembly, according to claim 8, wherein:

ends of said projections have tapped holes formed therein; and further including fasteners, set in said apertures, and fastened into said tapped holes.

* * * * *